US009920896B2

(12) United States Patent
Leary et al.

(10) Patent No.: US 9,920,896 B2
(45) **Date of Patent: *Mar. 20, 2018**

(54) COMBINATION SOLAR/LOW-VOLTAGE LIGHTING APPARATUS

(71) Applicant: Vinylast, Inc., Lakewood, NJ (US)

(72) Inventors: Steven J. Leary, Barnegat, NJ (US); Benjimin Yin, Hong Kong (HK); Zhang Qi, Guangzhou (CN)

(73) Assignee: Vinylast, Inc., Lakewood, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/421,784

(22) Filed: Feb. 1, 2017

(65) Prior Publication Data

US 2017/0146206 A1 May 25, 2017

Related U.S. Application Data

(63) Continuation of application No. 14/163,024, filed on Jan. 24, 2014, now Pat. No. 9,578,696.

(51) Int. Cl.

| | |
|---|---|
| ***H05B 33/08*** | (2006.01) |
| ***F21S 9/03*** | (2006.01) |
| ***F21S 4/10*** | (2016.01) |
| ***F21V 23/04*** | (2006.01) |
| ***F21S 8/08*** | (2006.01) |

(52) U.S. Cl.

CPC ..... *F21S 9/037* (2013.01); *F21S 4/10* (2016.01); *F21S 8/085* (2013.01); *F21V 23/04* (2013.01)

(58) Field of Classification Search

None

See application file for complete search history.

(56) References Cited

U.S. PATENT DOCUMENTS

| | | | | |
|---|---|---|---|---|
| 5,367,442 | A * | 11/1994 | Frost | F21S 8/081 136/291 |
| 7,670,023 | B1 | 3/2010 | Peterson | |
| 8,212,460 | B1 | 7/2012 | Hsieh | |
| 8,723,434 | B2 * | 5/2014 | Watson | H05B 33/0809 315/201 |
| 2005/0248285 | A1 | 11/2005 | Richmond | |
| 2008/0007181 | A1 | 1/2008 | Pickering | |
| 2009/0154148 | A1 * | 6/2009 | Meyer | F21L 2/00 362/157 |
| 2009/0206759 | A1 | 8/2009 | Wang | |
| 2009/0251887 | A1 | 10/2009 | Chronopoulos | |
| 2011/0168240 | A1 | 7/2011 | Forrest | |
| 2014/0056001 | A1 * | 2/2014 | Hsu | F21V 23/006 362/249.02 |
| 2014/0268771 | A1 * | 9/2014 | Heikman | F21V 29/004 362/249.02 |

FOREIGN PATENT DOCUMENTS

| | | |
|---|---|---|
| CN | 201902977 | 7/2011 |

* cited by examiner

*Primary Examiner* — Dedei K Hammond

(57) ABSTRACT

A lighting apparatus includes a housing, a plurality of lighting elements coupled to the housing, wherein a first subset of the plurality of lighting elements is powered by a solar power source and a second subset of the plurality of lighting elements is powered by a low-voltage electrical power source, and a switch for selectively switching between operation of the first subset and the second subset.

14 Claims, 5 Drawing Sheets

100

100

COMBINATION SOLAR/LOW-VOLTAGE LIGHTING APPARATUS

BACKGROUND OF THE DISCLOSURE

Solar and low-voltage lighting are two popular types of lighting that are commonly used in landscaping.

Solar lighting systems generally use small solar panels to harness energy from the sun, which is in turn used to power light emitting diodes (LEDs). The simplicity of such systems (e.g., lack of wiring or potentially harmful chemicals) makes them extremely easy to install and maintain. Moreover, the systems tend to be very energy efficient and long lasting, because they use durable light sources (i.e., LEDs) that are powered by a renewable energy source (i.e., the sun). However, the illumination provided by solar lighting systems tends to be less bright than that provided by other lighting systems, and they may not be ideal options for locations that do not receive sufficient sun.

Low-voltage lighting systems typically use traditional light bulbs powered by low-voltage electricity. These systems are capable of providing illumination in varying degrees of brightness and tend to be very versatile in terms of placement. However, they also tend to require more frequent upkeep due to the shorter life spans of the component parts (e.g., light bulbs and wiring need to be periodically replaced).

SUMMARY OF THE INVENTION

A lighting apparatus includes a housing, a plurality of lighting elements coupled to the housing, wherein a first subset of the plurality of lighting elements is power by a solar powered source and a second subset of the plurality of lighting elements is powered by a low-voltage electrical power source, and a switch for selectively switching between operation of the first subset and the second subset.

In another embodiment, a cap light for mounting to an end of a post includes a housing having a top side and a bottom side, connections within the housing, for coupling to a low voltage electrical power source, a solar panel mounted to the top side, for converting light energy from the sun into electricity, a plurality of lighting elements mounted to the bottom side, wherein a first subset of the plurality of lighting elements is powered by the light energy and a second subset of the plurality of lighting elements is powered by the low-voltage electrical power source, and a switch for selectively switching between operation of the first subset and the second subset.

BRIEF DESCRIPTION OF THE DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION

In one embodiment, the invention is a combination solar/low-voltage lighting apparatus. Embodiments of the invention provide a cap light that can be mounted, for example, atop a post of a railing (such as that used for fencing, decking, and similar structures). In one embodiment, the cap light is powered using solar energy up to a threshold point of drain. Once the threshold point of drain is reached, the power source switches to a low-voltage power supply. Embodiments of the cap light include interchangeable spacer rings, which allow the same cap light to be mounted to mounts (e.g., posts) of different sizes.

Figure 1A:
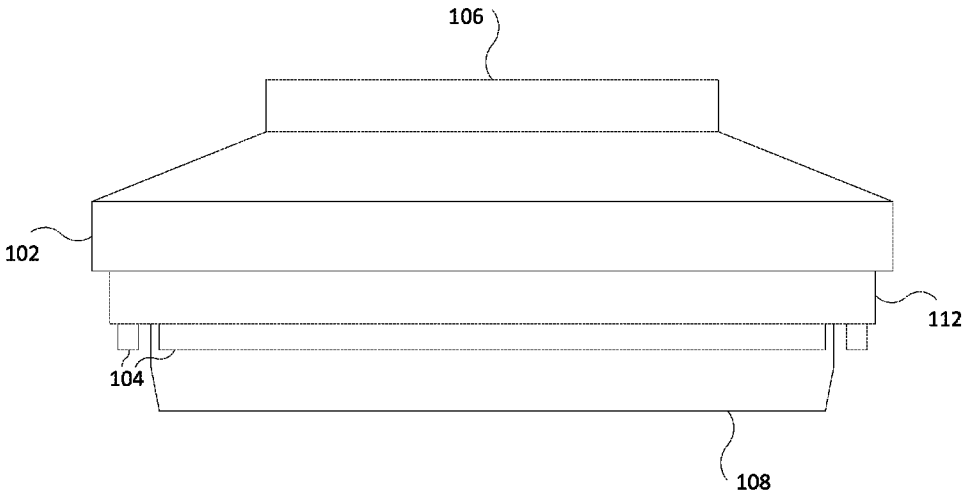
FIGS. 1A-1C collectively illustrate one embodiment of a lighting apparatus, according to the present invention.
Figure 1B:
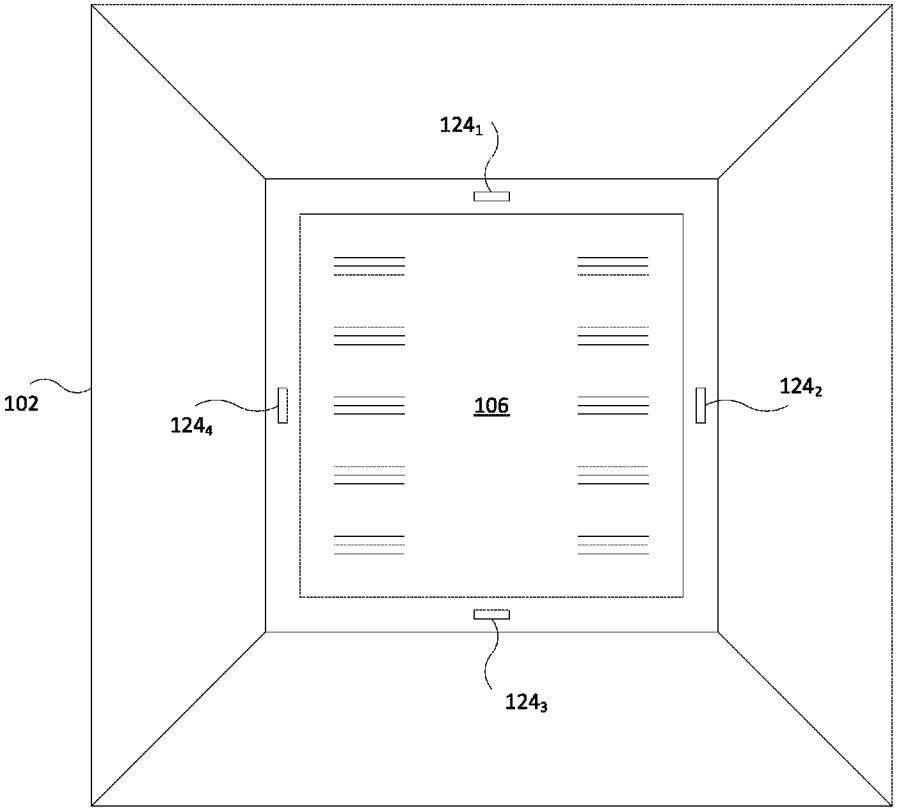
Figure 1C:
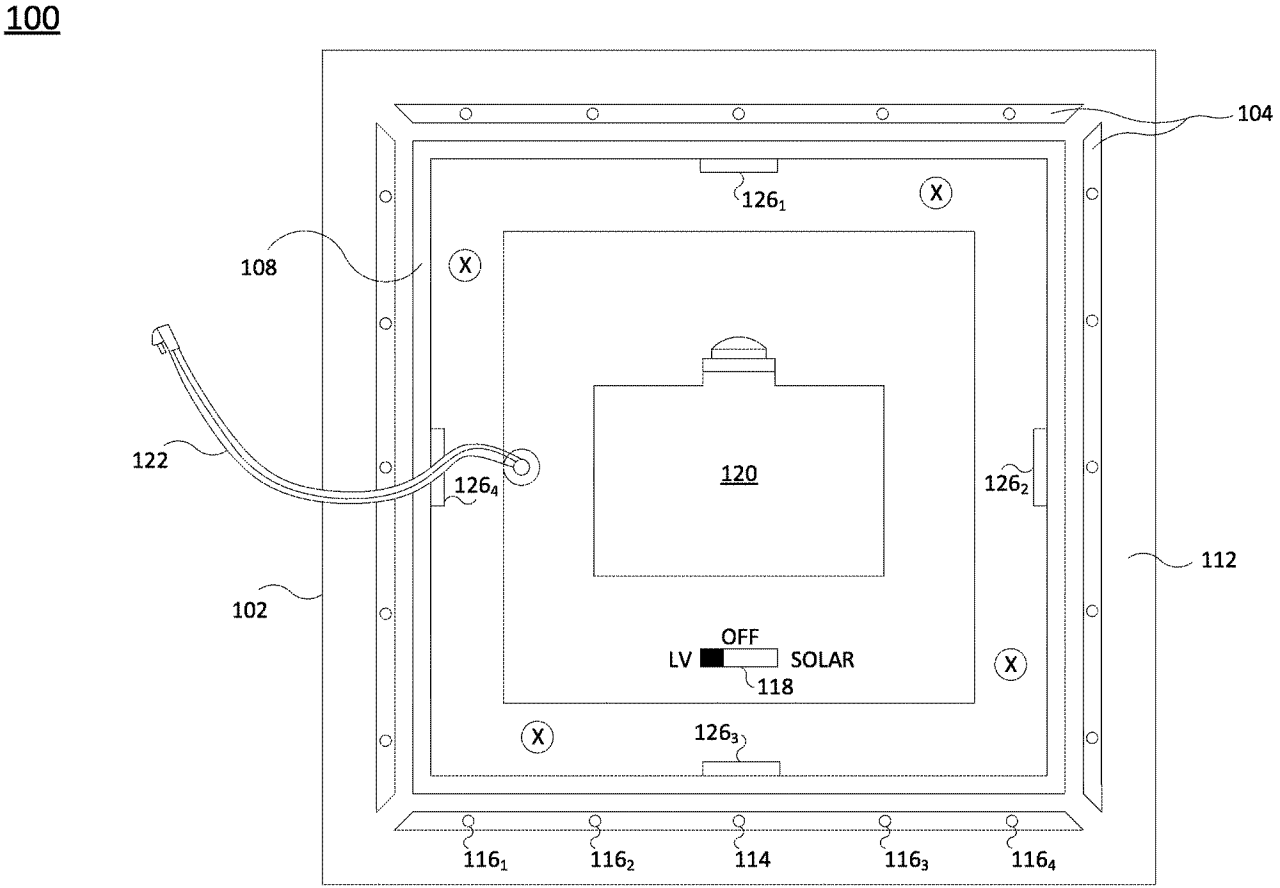

FIGS. 1A-1C collectively illustrate one embodiment of a lighting apparatus 100, according to the present invention. In particular, FIG. 1A illustrates a side view of the apparatus 100; FIG. 1B illustrates a top view of the apparatus 100; and FIG. 1C illustrates a bottom view of the apparatus 100. As discussed above, the illustrated embodiment depicts the apparatus 100 as a cap light; however, other configurations and implementations of the apparatus are possible without departing from the scope of the present invention. Thus, FIGS. 1A-1C are not intended to limit the apparatus to implementation as a cap light. Moreover, although the apparatus 100 is illustrated as having generally square-shaped dimensions, it will be appreciated that the dimensions of the apparatus 100 may vary (for instance, the apparatus 100 may be manufactured with generally circular dimensions to fit a round post).

Referring simultaneously to FIGS. 1A-1C, the apparatus 100 generally comprises a housing 102, a light source 104, and a solar panel 106. The housing 102 is shaped as a cap and is configured to fit over the end of a post, such as the type of post used in railing systems. As such, the bottom or underside of the housing 102 includes a recess that is sized and shaped to accommodate the end of a post therein. The recess is enclosed by a rim 108 that secures the apparatus 100 to the post.

A lip 112 extends beyond the perimeter of the rim 108, creating an overhang upon which the light source 104 is mounted; thus, the light source 104 is positioned around the recess. In one embodiment, the light source 104 comprises one or more ribbon lights mounted around the perimeter of the lip 112. Each ribbon light includes a first subset of lighting elements powered by solar energy and a second subset of lighting elements powered by a lower-voltage source of electricity. In one particular embodiment, each ribbon light includes five lighting elements (e.g., bulbs or light emitting diodes) positioned within a transparent or semi-transparent casing: a center lighting element 114 that is powered by a solar energy source (e.g., the solar panel 106) and two lighting elements $\mathbf{116}_1$-$\mathbf{116}_4$ (hereinafter collectively referred to as "lighting elements 116") positioned on either side of the center lighting element 114 and powered by a low-voltage electricity source.

The underside of the housing 102 further includes a switch 118 located within the recess. The switch 118 allows a user to selectively switch between power sources for providing power to the light source 104. In one embodiment, the switch 118 has three positions: low voltage ("LV"), solar, and off. Thus, the switch 118 can also be used to power off the light source 104.

In a further embodiment, the underside of the housing 102 also includes a battery compartment 120 for holding one or more batteries for powering the light source 104. The battery compartment 120 further includes pressure contacts or other mechanisms known in the art for electrically connecting the batteries to the light source 104. The underside of the housing 102 may further comprise access to the circuitry and wiring 122 necessary to hardwire the light source 104 directly to a source or low-voltage electricity (a majority of the circuitry and wiring may be protectively contained within the housing 102). Thus, the low-voltage power source may be either a battery or a hard-wired source.

The solar panel 106 comprises a set of solar photovoltaic modules that convert light energy from the sun into electricity. The solar panel 106 is mounted to a top side of the housing 102, such that the light source 104 is positioned between the recess and the solar panel 106. This allows the solar panel 106 the most direct access to the solar energy required to power the light source 104.

Thus, the apparatus 100 provides the ability to selectively switch between solar and low-voltage operation in a single lighting source. This versatility allows one to account for power consumption, power availability, maintenance, lighting quality, and other issues on-demand. Moreover, further embodiments of the apparatus 100 include software for automatically switching between solar and low-voltage operation. For instance, the software may allow the apparatus 100 to rely on solar energy up to a threshold point of drain, and once the threshold point of drain is reached, the software will switch to the low-voltage power supply.

Figure 2A:
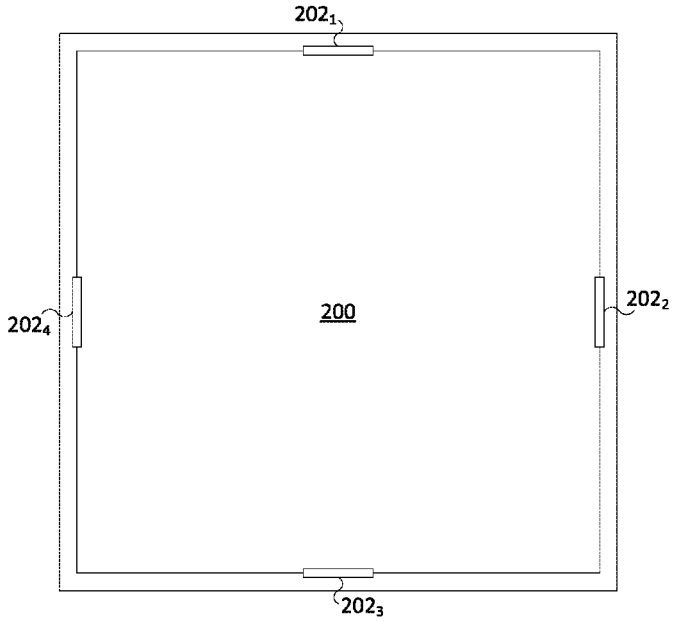
FIGS. 2A-2B collectively illustrate one embodiment of a cap that may be employed with the apparatus illustrated in FIG. 1.
Figure 2B:
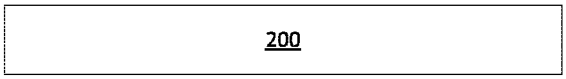

In one embodiment, the apparatus 100 further includes a set of interchangeable caps for protecting the solar panel 106. FIGS. 2A-2B, for example, collectively illustrate one embodiment of a cap 200 that may be employed with the apparatus 100 illustrated in FIG. 1. In particular, FIG. 2A illustrates a bottom view of the cap 200; while FIG. 2B illustrates a side view of the cap 200.

As illustrated, the cap 200 is substantially hollow, and the underside of the cap 200 includes a plurality of tabs $\mathbf{202}_1$-$\mathbf{202}_4$ (hereinafter collectively referred to as "tabs 202) protruding therefrom in a manner substantially perpendicular to the flat plane of the cap 200 (i.e., parallel to the sidewalls of the cap 200).

In one embodiment, the tabs 202 are positioned slightly inward of the cap perimeter (i.e., toward the center of the cap 200). The tabs 202 are sized and shaped to engage a plurality of slots $\mathbf{124}_1$-$\mathbf{124}_4$ (hereinafter collectively referred to as "slots 124") in the housing 102 of the apparatus 100. These slots 124 are positioned around the perimeter of the solar panel 106, as illustrated in FIG. 1B. When the tabs 202 on the cap 200 engage the slots 124 in the housing 102, the cap 200 is securely fastened over the solar panel 106.

As discussed above, the apparatus 100 may include a set of multiple, interchangeable caps 200. In one embodiment, at least one of the caps 200 is transparent (or semi-transparent). A transparent cap 200 will protect the solar panel 106 from exposure to the elements, while at the same time allowing the solar panel 106 the most direct access to solar energy. In a further embodiment, at least one of the caps 200 is opaque. An opaque cap 200 will protect the solar panel 106 and at the same time conceal the solar panel 106 from view. Thus, an opaque cap 200 may be preferable for aesthetic reasons when the apparatus 100 is intended to be powered by low-voltage electricity.

It is noted that posts to which the apparatus 100 may be mounted may come in a variety of dimensions. For instance, the cross-sectional dimensions (e.g., aspect ratios) of a post can vary. For this reason, in one embodiment, a removable spacer ring may be deployed with the apparatus 100 in order to mount the apparatus 100 securely to posts having smaller dimensions.

Figure 3A:
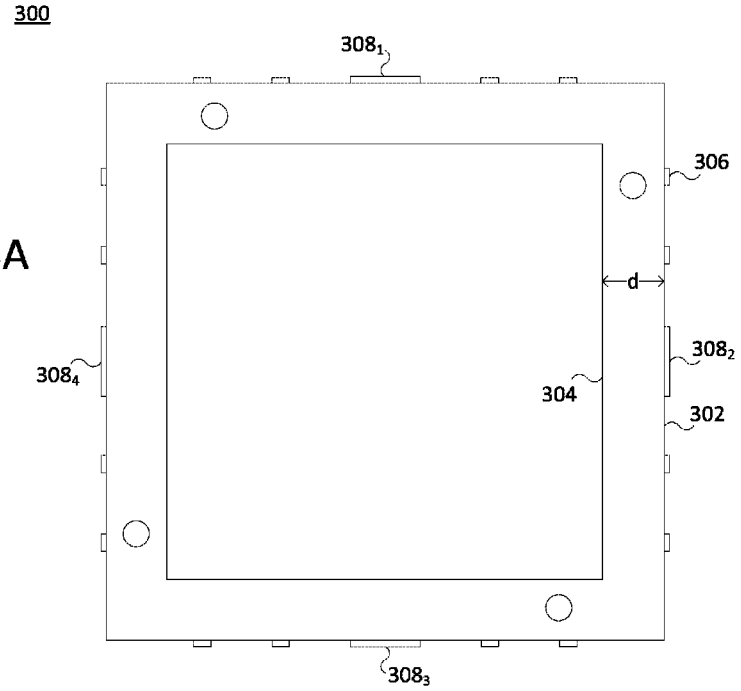
FIGS. 3A-3B collectively illustrate one embodiment of a spacer ring that may be employed with the apparatus illustrated in FIG. 1.
Figure 3B:
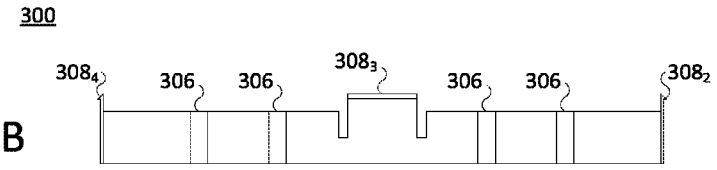

FIGS. 3A-3B, for example, collectively illustrate one embodiment of a spacer ring 300 that may be employed with the apparatus 100 illustrated in FIG. 1. In particular, FIG. 3A illustrates a top view of the spacer ring 300; while FIG. 3B illustrates a side view of the spacer ring 300.

An outer perimeter 302 of the spacer ring 300 has dimensions configured to fit securely within the rim 108 on the underside of the housing 102 (i.e., the dimensions of the outer perimeter are slightly smaller than the dimensions of the rim); the inner perimeter 304 of the spacer ring 300 has dimensions configured to securely fit over the end of a post (i.e., the dimensions of the inner perimeter 304 are slightly larger than the dimensions of the end of the post). Thus, the spacer ring 300 shrinks the dimensions of the recess in the underside of the housing 102 to fit posts of different dimensions. In one embodiment, the distance, d, between the outer perimeter 302 and the inner perimeter 304 is variable, so that the degree to which the recess is shrunk is also variable. For instance, the apparatus 100 may include a plurality of spacer rings 300, where the distance d is different for each of the spacer rings 300.

The outer perimeter 302 of the spacer ring 300 includes a plurality of ribs 306, as well as a plurality of tabs $\mathbf{304}_1$-$\mathbf{304}_4$ (hereinafter collectively referred to as "tabs 304"). The ribs 306 and tabs 304 help to secure the spacer ring 300 in place in the housing 302. In particular, the spacer ring 300 is positioned within the recess in the underside of the housing 102, with the tabs 308 facing into the recess. When the tabs 308 engage a plurality of slots $\mathbf{126}_1$-$\mathbf{126}_4$ (hereinafter "slots 126) in the underside of the housing 102 (illustrated in FIG. 10), and the ribs 306 frictionally engage the rim 108, the spacer ring 300 is securely fastened to the housing 102.

Although various embodiments which incorporate the teachings of the present invention have been shown and described in detail herein, those skilled in the art can readily devise many other varied embodiments that still incorporate these teachings.

What is claimed is:

1. A lighting apparatus, comprising:

a single ribbon light containing a plurality of lighting elements, wherein each lighting element in the plurality of lighting elements belongs to either a first subset or a second subset, wherein the first subset is powered by a solar power source and the second subset is powered, independently of the first subset, by a low-voltage electrical power source; and a switch for selectively switching between operation of the first subset and the second subset.

2. The lighting apparatus of claim 1, further comprising:

a solar panel coupled to the first subset, for converting light energy from the sun into electricity for powering the first subset.

3. The lighting apparatus of claim 2, further comprising a cap removably positioned over the solar panel.

4. The lighting apparatus of claim 3, wherein the cap is completely opaque.

5. The lighting apparatus of claim 3, wherein the cap is transparent.

6. The lighting apparatus of claim 1, wherein the lighting apparatus is shaped as a cap for fitting over an end of a post.

7. The lighting apparatus of claim 6, wherein the lighting apparatus includes a recess having dimensions configured to fit over the end of the post.

8. The lighting apparatus of claim 7, further comprising:

a spacer ring sized to fit removably within the recess and having dimensions configured to shrink a size of the recess when the spacer ring is positioned within the recess.

9. The lighting apparatus of claim 8, wherein the dimensions comprise:

an outer perimeter configured to fit removably within a rim enclosing the recess; and an inner perimeter configured to fit removably over the end of the post, wherein the outer perimeter further comprises a plurality of tabs to engage a plurality of slots in the recess.

10. The lighting apparatus of claim 9, wherein the outer perimeter further comprises a plurality of ribs to frictionally engage the recess.

11. The lighting apparatus of claim 1, wherein the low-voltage electrical power source is a battery.

12. The lighting apparatus of claim 1, wherein the low-voltage electrical power source is hard-wired.

13. A lighting apparatus, comprising:

a single ribbon light containing a plurality of lighting elements, wherein each lighting element in the plurality of lighting elements belongs to either a first subset or a second subset, wherein the first subset is powered by a solar power source and the second subset is powered, independently of the first subset, by a low-voltage electrical power source;

a switch for selectively switching between operation of the first subset and the second subset; and a cap removably positioned over the solar panel, wherein the cap is completely opaque.

14. A lighting apparatus, comprising:

a single ribbon light containing a plurality of lighting elements, wherein each lighting element in the plurality of lighting elements belongs to either a first subset or a second subset, wherein the first subset is powered by a solar power source and the second subset is powered, independently of the first subset, by a low-voltage electrical power source; and a switch for selectively switching between operation of the first subset and the second subset, wherein the lighting apparatus is shaped as a cap for fitting over an end of a post and includes a recess having dimensions configured to fit over the end of the post, and wherein the lighting apparatus further comprises a spacer ring sized to fit removably within the recess and having dimensions configured to shrink a size of the recess when the spacer ring is positioned within the recess.

* * * * *